US005266040A

United States Patent [19]

Merrill et al.

[11] Patent Number: 5,266,040

[45] Date of Patent: Nov. 30, 1993

[54] RELEASABLE ELECTRIC CONNECTOR ASSEMBLY

[75] Inventors: James M. Merrill, Hopkington, Mass.; Joseph Field, Hudson, N.H.

[73] Assignee: Cleaner Image Associates, Inc., Shrewsbury, Mass.

[21] Appl. No.: 916,534

[22] Filed: Jul. 20, 1992

[51] Int. Cl.[5] ..... H01R 13/00

[52] U.S. Cl. ..... 439/159

[58] Field of Search ..... 439/152-160

[56] References Cited

U.S. PATENT DOCUMENTS

| | | | |
|---|---|---|---|
| 2,445,608 | 7/1948 | Detweiler | 173/332 |
| 2,456,548 | 10/1946 | Weiner et al. | 173/361 |
| 2,532,538 | 1/1950 | Burtt et al. | 173/328 |
| 2,571,046 | 3/1951 | Malsey | 173/361 |
| 2,688,734 | 9/1954 | Welling | 439/159 |
| 2,696,594 | 8/1954 | Harrington et al. | 339/45 |
| 2,817,825 | 3/1956 | Zettle et al. | 339/45 |
| 3,008,115 | 2/1961 | Oakes | 339/45 |
| 3,475,715 | 10/1969 | Venaleck | 439/159 |
| 3,609,635 | 10/1971 | Harris | 339/45 |
| 3,784,958 | 1/1974 | Harris | 439/159 |
| 4,045,106 | 6/1977 | Borg | 339/45 |
| 4,114,969 | 3/1978 | Brog | 339/45 |
| 4,140,259 | 1/1979 | Kostka et al. | 225/16 |
| 4,176,899 | 2/1979 | Betts | 439/155 |
| 4,320,176 | 12/1989 | Niikura | 439/152 |
| 4,340,267 | 8/1982 | Nukaga | 339/42 |
| 4,586,768 | 10/1986 | Eck | 339/45 |
| 4,850,886 | 12/1989 | Berke | 439/152 |
| 4,907,981 | 12/1990 | Gallusser et al. | 439/258 |

*Primary Examiner*—Joseph H. McGlynn
*Attorney, Agent, or Firm*—Nields & Lemack

[57] ABSTRACT

A release mechanism for an electrical plug, and a method of releasing the plug from a socket. The release mechanism includes a perimeter ejecting member which substantially surrounds the electrical contact prongs of the plug and is moveable with respect thereto. A remote switch is energized, which activates the release mechanism and disengages the plug from the socket by sliding over the contact prongs.

7 Claims, 3 Drawing Sheets

RELEASABLE ELECTRIC CONNECTOR ASSEMBLY

BACKGROUND OF THE INVENTION

Conventional electric plugs typically have two or three electrical contact prongs which are inserted into an electrical outlet receptacle or socket of conventional construction. The plugs are attached by a cord to the end application, such as an electrical appliance. Where such appliances are portable, it is desirable that the cord be of sufficient length to permit operation of the appliance at locations remote from the electrical socket.

For example, vacuum cleaners often have long cords so that vacuuming of large rooms or of rooms adjacent to where the electrical socket being used is located can be accomplished without continually unplugging and replugging the cord into closer electrical sockets. However, unless the cord is of such a length to permit the operator to complete the task while using only one socket, the operator must continually return to the particular socket in use to manually unplug the cord by grasping and pulling the plug from the socket, and replug the cord into a different socket that is closer to the next area to be worked on. This is a time-consuming and labor intensive process, especially in an industrial setting where it is repeated be each worker many times over the course of a work day.

In order to avoid the time and energy necessary to continually return to the socket in use and unplug the cord, many appliance operators pull on the cord itself at a location remote from the socket in an attempt to disengage the plug from the socket. However, such a procedure is obviously undesirable, as short circuits, bending of the electrical prongs, breaking of the wire, possible electric shock, etc. often result.

One attempt to solve the aforementioned problems is disclosed in U.S. Pat. No. 2,688,734. That patent teaches an electrically releasable electric connector in which a plunger is activated by a remote switch to project from the connector body between the two prongs of the plug and against the electrical socket. Of similar operation is the self-ejecting plug disclosed U.S. Pat. No. 3,475,715. However, each of these devices employs an ejecting mechanism that is located between the two electrical contact prongs. Consequently, the ejector must be made of a non-conducting material in order to avoid short circuiting. In addition, if the fit between the outlet receptacle and the electrical contact prongs is so tight that operation of the device results in only partial disengagement of the plug from the receptacle, there is a danger that the operator may receive an electrical shock in attempting to remove the plug from the receptacle, since the electrical prongs are exposed. When the plug falls to the ground upon ejection, the exposed prongs are liable to bend or break from the impact. Furthermore, each of the aforementioned prior art devices appears limited in application to two-pronged plugs; it is not at all apparent that the release mechanisms disclosed would function properly in plugs having three or more prongs.

An alternative construction is shown in U.S. Pat. No. 4,045,106, which discloses an automatic electric plug release in which the plug is spring loaded. By pulling on the cord, the terminal prongs are withdrawn into the mounting member. However, such a construction requires that the electrical contacts themselves be moveable. In addition, the user must pull on the cord at a position close to the socket, thereby requiring the aforementioned time-consuming and labor-intensive procedure of continually returning to the socket to disengage the plug.

SUMMARY OF THE INVENTION

The problems of the prior art have been overcome by the instant invention, which provides a convenient, easy to use, effective release mechanism for an electrical plug, and a method of releasing the plug from a socket. In general terms, the instant release mechanism includes a perimeter ejecting member which substantially surrounds the electrical contact prongs of the plug and is moveable with respect thereto. A remote switch is energized, which activates the release mechanism and disengages the plug from the socket by sliding over the contact prongs.

The operator of the electrical device, such as a vacuum cleaner, need only activate the remote switch to disengage the plug; the operator need not physically return to the electrical outlet. This eliminates backtracking, which often is associated with "vacuuming over the cord", resulting in cord breakage.

DETAILED DESCRIPTION OF THE INVENTION

Figure 1:
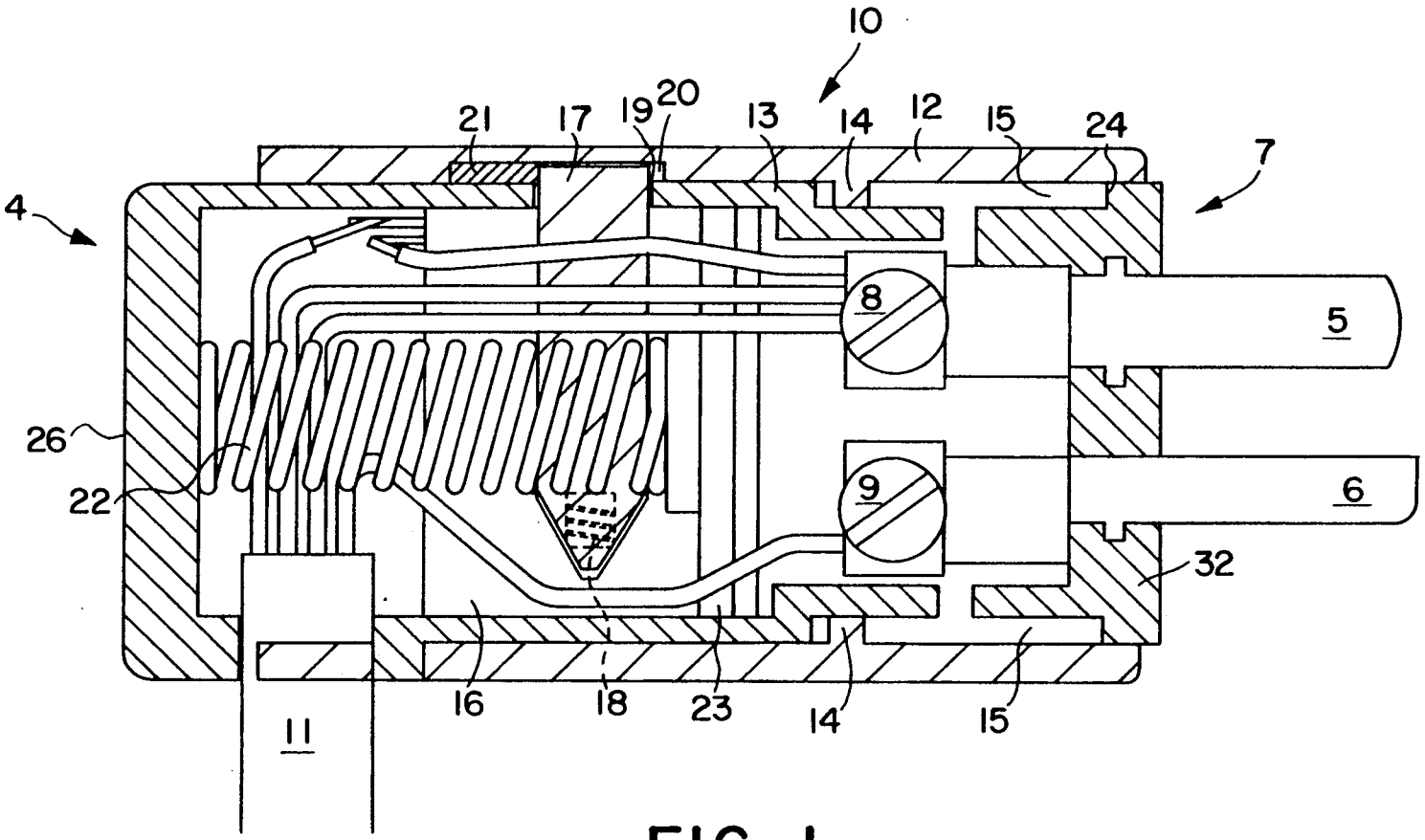
FIG. 1 is a cross-sectional view of the electrical plug in a pre-activated cocked condition.

Turning first to FIG. 1, conventional electrical contact members or prongs 5 and 6 are shown projecting from the distal end 7 of the plug 10. In the embodiment shown, prong 6 is a separate ground prong, thereby necessitating a third prong (not shown). Those skilled in the art will recognize that any number of prongs may be used without departing from the sprit and scope of the present invention. Electrical connection between the prongs and the electrical device attached to the plug can be made at screws 8 and 9 in a conventional manner. The prongs are adapted to be inserted into an electrical outlet receptacle or socket of conventional construction (not shown). A cord 11 (four conductor in the case shown) extends through an opening in the proximal end 4 of the plug 10, although its exact position is not critical to the instant invention. Preferably the proximal end 4 of the plug 10 is oval or hexagonally shaped so that the plug 10 is less prone to snagging during retrieval.

The plug 10 is defined by an outer housing 12 and an inner housing 13, each made of a suitable durable, electrically insulating material such as plastic. The outer and inner housings 12 and 13 are moveable with respect to each other. In the embodiment shown, the outer housing 12 has a generally cylindrical exterior, although other suitable shapes such as hexagonal can be used. Outer housing 12 has an inner notch 14 extending at least partially along the inner perimeter of the housing, which slides within inner gutter 15 in inner housing 13 for the purpose to be described below. Proximal end 4 of inner housing 13 can be a removable end cap 26 to allow for easily assembly and disassembly of the device.

A solenoid 16 is housed in inner housing 13, and is electrically coupled to prong 5 and cord 11. Although AC solenoids are operable, preferably solenoid 16 is a DC solenoid, which provides 60 pulses per second to the solenoid plunger 17 which helps to overcome static friction, etc. Solenoid 16 includes solenoid plunger 17 and push spring 18. In the plug's pre-activated, cocked position shown in FIG. 1, the plunger 17 extends through a recess 19 in inner housing 13, and the push spring 18 forces plunger 17 to occupy a portion of a gutter 20 formed in the interior of outer housing 12. Also occupying a portion of gutter 20 is a fixed latch bar 21. Alternatively, as will become apparent below, the gutter 20 could be so dimensioned to allow only plunger 17 to occupy it. Upon activation of the solenoid, push spring 18 is compressed and thereby withdraws the plunger 17 from the gutter 20.

Figure 3:
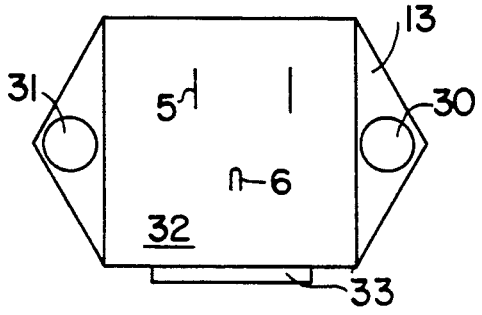
FIG. 3 is a front view of one embodiment of the inner housing of the electrical plug of the present invention.

Turning now to FIG. 3, a pair of ejection springs 22 (only one shown) positioned on either side of solenoid 16 each extend from the proximal end 4 of the plug 10 towards the distal end 7. In the embodiment where the plug 10 is hexagonally shaped, the proximal ends of the springs may rest in holes 30, 31 partially formed in the sides of the inner housing 13, and the distal end of the springs press against indentations 34, 35 (FIG. 4) formed in transverse barrier plate 23 of outer housing 12. Although two ejection springs are preferred, more or less could be used as long as sufficient force can be generated to propel the outer housing in the direction of prongs 5 and 6 and to positively disengage the plug from the socket as discussed below. In the pre-activated cocked position of FIG. 1, the ejection springs are compressed, and the prongs 5 and 6 are exposed and can be inserted into an electrical outlet.

Figure 2:
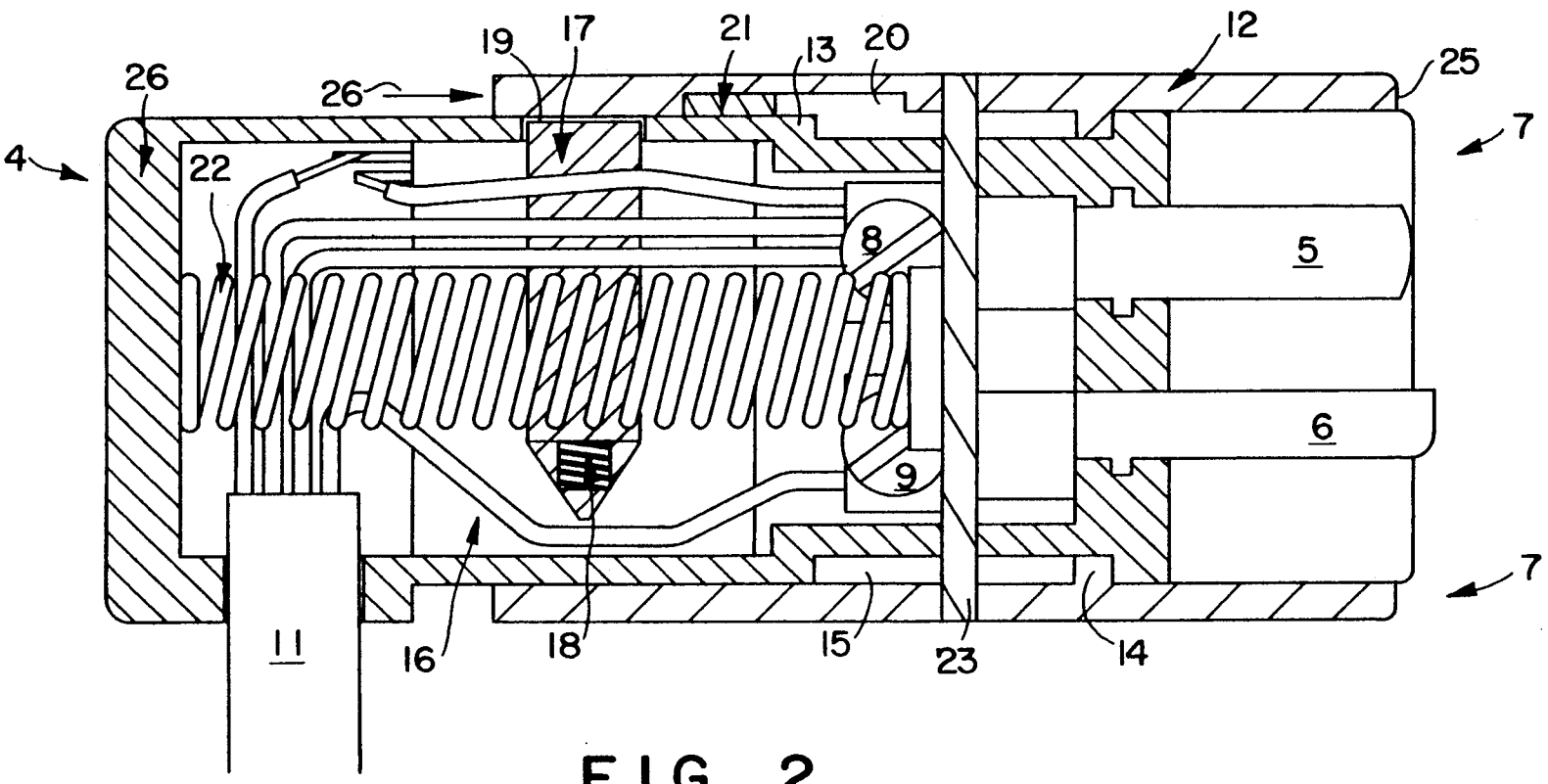
FIG. 2 is a cross-sectional view of the electrical plug in a post-activated condition.

In operation, the prongs 5 and 6 of the plug (as well as additional prongs where applicable) in its pre-activated, cocked position of FIG. 1 are inserted into an electrical outlet receptacle in the conventional manner. When it is desired to remove the plug from the outlet, the solenoid 16 is activated by a conventional switch (not shown) preferably located in proximity to the electrical device electrically connected to solenoid 16 via cord 11, causing the push spring 18 to withdraw the plunger 17 from gutter 20, which in turn allows outer housing 12 to slide freely along inner housing 13. As best seen in FIG. 2, ejection springs 22 force outer housing 12 to slide in the distal direction (arrow 26), causing annular latch 14 to slide in gutter 15 until latch 14 contacts annular shoulder stop 24 of formed by faceplate 32 attached to the inner housing 13. Outer housing 12 moves with sufficient force such that as its distal end 25 contacts the electrical outlet (not shown) or faceplate thereof (not shown), causing the prongs 5 and 6 (and optionally additional prongs where applicable) to be forced proximally and disengage from the outlet. In this disengaged state, the outer housing substantially surrounds the prongs to the extent that the fingers of the operator cannot fit between the electrical outlet and the plug and thus touch the prongs in the event the plug is not completely disengaged from the outlet. This configuration minimizes the possibility of electrical shock. In addition, the outer housing protects the prongs from bending or breaking upon impacting the ground upon disengagement. Power to activate the solenoid is preferably supplied from the electrical outlet in which the plug is engaged, although other suitable sources can be used, such as a battery.

The plug can be re-cocked to the pre-activated condition of FIG. 1 simply by manually sliding outer housing 12 in the proximal direction until plunger 17 ejects out of recess 19 and into gutter 20, thereby locking the outer housing 12 in the pre-activated condition.

Figure 4:
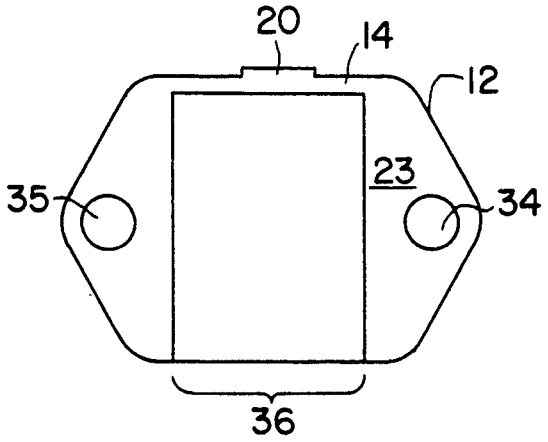
FIG. 4 is a rear view of one embodiment of the outer housing of the electrical plug of the present invention.

In an alternative embodiment, inner housing 13 can be formed with a track 33 and outer housing with a corresponding groove 36 in the area shown in FIG. 4, such that the outer housing 13 slides along the track 33.

It will be recognized by those skilled in the art that the size of the solenoid is not particularly limited, and depends in part on the voltage requirement of the electrical device being operated. The plug of the instant invention can be retrofitted on existing equipment, can be used in manufacture as original equipment, or can be used for extension cords.

What is claimed is:

1. A releasable electric plug, comprising a. electrical contact means for providing electrical connection to an electrical energy source;

b. housing means comprising an outer housing member and an inner housing member, said outer housing member being slidable with respect to said inner housing member from a first electrical energy source-engaging position to a second electrical energy source-disengaging position, said outer housing member substantially surrounding said electrical contact means in said second electrical energy source-disengaging position;

c. activation means for causing said outer housing member to move from said first position to said second position.

2. The releasable electric plug of claim 1, wherein said activation means comprises a switch remote from said electric plug.

3. The releasable electric plug of claim 1, wherein said activation means comprises a solenoid.

4. The releasable electric plug of claim 3, wherein said solenoid comprises a moveable plunger, and wherein:

said inner housing member comprises a recess through which said plunger extends when said plug is in said first position, and an inner housing gutter; and said outer housing member comprises an outer housing gutter into which said plunger extends when said plug is in said first position, and an inner notch slidingly received by said inner housing gutter.

5. The releasable electric plug of claim 3, wherein said activation means further comprises at least one ejection spring associated with said outer housing member so as to urge said housing member from said first position to said second position.

6. A method of remotely disengaging an electric plug from an electrical receptacle, said electric plug comprising:

electrical contact means for providing electrical connection to an electrical energy source;

housing means comprising an outer housing member and an inner housing member, said outer housing member being slidable with respect to said inner housing member from a first electrical energy source-engaging position to a second electrical energy source-disengaging position, said outer housing member substantially surrounding said electrical contact means in second electrical energy source-disengaging position;

activation means for causing said outer housing member to move from said first position to said second position, said activation means comprises a solenoid having a moveable plunger, said inner housing member comprising a recess through which said plunger extends when said plug is in said first position, and an inner housing gutter, and said outer housing member comprising an outer housing gutter into which said plunger extends when said plug is in said first position, and an inner notch slidingly received by said inner housing gutter;

said method comprising:

activating said activation means such that said plunger is withdrawn from said outer housing gutter causing said outer housing to move from said first position to said second position and thereby disengaging said electric plug from said electrical receptacle.

7. The method of claim 6, wherein upon activating said activation means, said notch slides along said inner housing gutter.

* * * * *